US005538787A

United States Patent [19]

Nachtman et al.

[11] Patent Number: 5,538,787

[45] Date of Patent: Jul. 23, 1996

[54] MATERIAL AND METHOD FOR FORMING AN UNDERWATER BARRIER LAYER

[75] Inventors: Thomas J. Nachtman, Temperance, Mich.; John H. Hull, Toledo, Ohio

[73] Assignee: New Waste Concepts, Inc., Perrysburg, Ohio

[21] Appl. No.: 268,633

[22] Filed: Jun. 30, 1994

Related U.S. Application Data

[63] Continuation of Ser. No. 243,687, May 16, 1994, abandoned.

[51] Int. Cl.[6] ..... B32B 5/12; E02B 3/12

[52] U.S. Cl. ..... 428/323; 405/17; 405/268; 405/270; 428/403; 428/404; 428/407; 428/688

[58] Field of Search ..... 428/403, 407, 428/323, 688, 404; 210/696, 807, 502.1, 503, 504, 506; 405/17, 270, 268

[56] References Cited

U.S. PATENT DOCUMENTS 2,728,733 12/1955 Hashimoto ..... 252/449

4,011,175 3/1977 Preus ..... 252/427

5,035,804 7/1991 Stowe ..... 210/671

*Primary Examiner*—D. S. Nakarani

*Assistant Examiner*—H. Thi Le

*Attorney, Agent, or Firm*—MacMillan, Sobanski & Todd

[57] ABSTRACT

A bead for forming a barrier layer over an underwater surface. Generally, a plurality of such beads are required to form an effective underwater barrier layer. Each of the beads comprises a core, preferably formed of a piece of gravel. A sealant layer is provided which at least partially encapsulates this core. The sealant layer includes a clay and a binder. The binder facilitates the adhesion of the sealant layer to the core of the bead. To form such an underwater barrier layer over contaminated sediments beneath a body of water, a plurality of the beads are deposited on top of the contaminated sediments.

17 Claims, 1 Drawing Sheet

MATERIAL AND METHOD FOR FORMING AN UNDERWATER BARRIER LAYER

CROSS REFERENCE TO RELATED APPLICATION

This application is a continuation in part of U.S. application Ser. No. 08/243,687, filed May 16, 1994, now abandoned.

BACKGROUND OF THE INVENTION

1. Field of the Invention

The invention relates generally to materials and methods for forming barrier layers and, more particularly, to a material and method for forming a barrier layer over a contaminated, underwater surface.

2. Summary of Related Art

A significant number of lakes, ponds, marshes, river beds and the like are contaminated with environmentally hazardous materials. Examples of such materials include polychlorinated biphenyls, or PCBs, white phosphorus, and metals. Many of these materials, once introduced by one means or another, settle on the bottoms of such bodies of water. This contaminated sediment is detrimental to the wildlife which utilizes the body of water, especially to the fish and foraging waterfowl.

In some cases, it is not feasible to remove or treat such sediment in situ. Thus, to prevent the wildlife from coming into contact with the contaminated sediment, it has been proposed to form a barrier layer over the contaminated sediment. To accomplish that, various plastic membrane barrier systems have been used previously. Such systems typically include a plastic membrane which is positioned on the bottom of the body of water with a layer of sand or similar material over the top of the plastic membrane to hold it in position. A number of venting pipes are usually required to permit the venting of gases which build up beneath the plastic membrane. These plastic membrane systems are relatively difficult and expensive to install. In addition, the plastic membranes are relatively easily punctured and are susceptible to cracking in response to the large temperature changes experienced in many underwater environments.

It would therefore be desirable to provide a relatively simple and inexpensive material for forming a barrier layer over a contaminated, underwater surface which is durable under varied temperature conditions. It would further be desirable to provide such a material which forms a barrier layer which is not susceptible to puncture or cracking and which does not require a venting system. It would also be desirable to provide an improved method of forming such a barrier layer.

SUMMARY OF THE INVENTION

The invention relates to a bead for forming a barrier layer over an underwater surface. A plurality of such beads are generally required to form an effective underwater barrier layer. Each of the beads comprises a core which is preferably formed of a piece of gravel. A sealant layer is provided which at least partially encapsulates the core of the bead. The sealant layer includes a clay and a binder. The binder helps to adhere the sealant layer to the core of the bead.

To form such an underwater barrier layer over contaminated sediments beneath a body of water, a plurality of the beads are deposited on top of the contaminated sediments. Once the beads are submerged, the sealant layer about each of the beads begins to absorb water and swell. A continuous layer of the clay and binder is thus formed, with the cores of the beads dispersed randomly throughout this layer.

The beads of the invention may also be used to form barrier layers in the presence of water in a variety of other applications. For instance, a plurality of the beads may be introduced into an annular well space formed between the ground and the well casing, typically formed of steel or plastic. Preferably, the entire annular space is filled with beads. If the annular space is dry, water is added. Once the beads are submerged, the sealant layer about each of the beads begins to absorb water and swell, and a continuous annular layer of the clay and binder is formed.

Various objects and advantages of the invention will become readily apparent to those skilled in the art from the following detailed description of a preferred embodiment when considered in the light of the accompanying drawings.

DESCRIPTION OF THE PREFERRED EMBODIMENT

Figure 1:
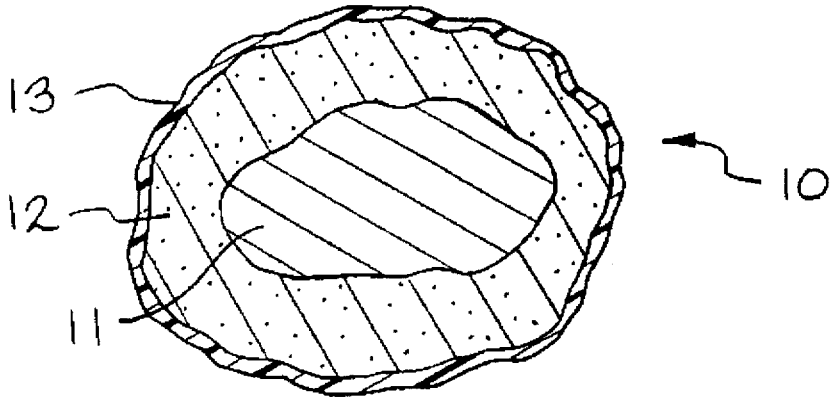
FIG. 1 is a sectional view of a single bead of the material for forming a barrier layer in accordance with this invention.

Referring now to the drawings, FIG. 1 illustrates a bead, indicated generally at 10, of the material for forming a barrier layer in accordance with this invention. As will be discussed in detail below, a plurality of such beads 10 are typically required to form an effective underwater barrier layer. The bead 10 is formed of a core 11 which is at least partially encapsulated by a sealant layer 12. The core 11 is preferably completely encapsulated by the sealing layer 12. In a preferred embodiment, a protective coating 13 is provided over the sealant layer 12.

The core 11 of the bead 10 is formed of a piece of a material which is relatively hard and dense when compared to the sealant layer 12. Examples of suitable materials for forming the core 11 include pieces of stone, iron ore, slag or crushed porcelain. Preferably, the core 11 of each bead 10 is formed of a piece of gravel.

As mentioned above, the core 11 is encapsulated by a sealant layer 12. The sealant layer 12 includes a clay material, or a mixture of clay materials, which exhibits a high absorption and swelling capacity. Preferably, the clay is a bentonite clay which is readily hydratable, such as calcium bentonite or sodium bentonite. In certain applications, especially in water having a relatively high salt content, the preferred clay is attipulgite clay. In a preferred embodiment, the sealant layer 12 may also include one or more organically modified clays, which also are referred to as organo clays. Such organo clays may be effective in binding with some contaminants, such as most metals, which come into contact with them.

The sealant layer 12 also includes a binder to promote the adhesion of the clay to the core 11 of the bead 10. An amount of the binder sufficient to bind the clay to the core 11 is mixed with the clay. Alternatively, a layer of the binder may be interposed between the clay and the core 11. The binder is preferably a polymeric material, such as a cellulosic polymer. A preferred binder is guar gum.

The sealant layer 12 may also include a setting material, such as gypsum or plaster of paris, which sets with water. This material is preferably mixed with the clay or mixture of clays forming the sealant layer, and may comprise up to 90% of the sealant layer 12 by weight.

A bird aversion agent may also be added to the beads 10. Suitable bird aversion agents include esters of anthranilic acid, esters of phenylacetic acid, or dimethyl benzyl carbinyl acetate, as examples. Preferred bird aversion agents are dimethyl anthranilate and methyl anthranilate. These bird aversion agents are preferably mixed in with the binder in amounts sufficient to repel foraging waterfowl which would come into contact therewith.

The bead 10 may be provided with an outer coating 13 which aids in keeping the sealant layer 12 intact prior to the deposition of the bead 10 on an underwater surface. Preferably, the bead is provided with a thin polymeric coating 13 about the sealant layer 12. A preferred material for the outer coating 13 is an acrylic resin. A latex, or a gypsum in water slurry, are additional examples of suitable materials for the outer coating 13. The outer coating 13 should not be of a thickness, dependent upon the particular material, which would prevent the eventual hydration of the sealant layer 12 of the bead 10 after the bead 10 is placed underwater.

The beads 10 in accordance with the invention may be formed in any suitable manner. Preferably, the binder is placed into an aqueous solution and mixed with the clay. A number of the cores 11 are added to this sealant mixture and stirred so that the sealant mixture adheres to the each of the cores 11. The sealant mixture may be allowed to dry about the cores 11, and then stirred with additional sealant mixture to form a multi-layered sealant layer 12 about each of the cores 11. The outer coating 13 may then be applied by any suitable means, such as by spraying.

Figure 2:
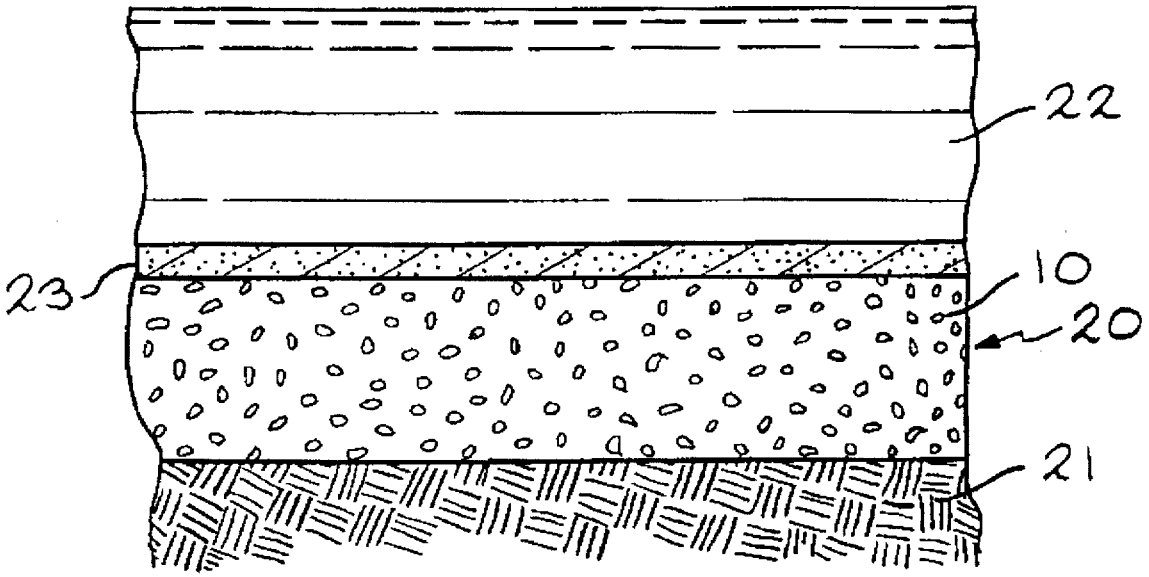
FIG. 2 is a sectional view of the barrier layer formed by the material and method of the invention.

An underwater barrier layer 20 formed from the beads 10 of this invention is illustrated in FIG. 2. The underwater barrier layer 20 covers a layer of contaminated sediments 21 which lies beneath a body of water 22. To form this barrier layer 20, a plurality of the beads 10 are deposited on top of the contaminated sediments 21. If the contaminated sediments 21 are underwater at the time of the deposition, the beads 10 may be dropped directly into the water 22. The beads 10 will sink, settling on top of the contaminated sediments 21. Since the beads 10 are relatively hard and impact resistant, they may be dropped into the water from the air, such as from a helicopter drop bucket. The beads 10 may also be pumped out over the contaminated sediments 21 using a conventional pump. Alternatively, if the climate permits, the beads 10 may be deposited when the water above the contaminated sediments 21 is frozen. The beads 10 may then be effectively deposited by means of a truck, road grader, low ground pressure bulldozer, or other suitable means. When the ice melts, the beads 10 will sink to the bottom, settling on top of the contaminated sediments 21.

Once the beads 10 are submerged, the sealant layer 12 about each of the beads 10 begins to absorb the water and to swell. A continuous layer of the clay and binder is thus formed, with the cores 11 dispersed randomly throughout. It is believed that the cores 11 aid in keeping the barrier layer 20 intact on top of the contaminated sediments 21. If a setting material such as gypsum or plaster of paris is included in the sealant layer 12 of the beads 10, this material will set when hydrated.

A sufficient number of the beads 10 are deposited over the area to form a physical barrier layer 20 of a thickness sufficient to prevent the migration of the contaminated sediments 21 into the water 22. Generally, a barrier layer 20 of a thickness of between about 4 to 8 cm is adequate to prevent the migration of contaminated sediments therethrough, as well as to prevent the animals and other organisms using that body of water from coming into contact with the sediments 21. Where a bird aversion agent has been added to the beads 10, it will be dispersed throughout the barrier layer 20, further discouraging foraging waterfowl from coming into contact with the contaminated sediments 21 beneath the barrier layer 20.

If desired, additional pelletized material may also be mixed with the beads 10 prior to their deposition on the contaminated sediments 21. Examples of such materials include pelletized fertilizer, sewage, sludge, cement kiln dust, lime, recycled plastic, corn cobs, flyash, sawdust and recycled paper. These additional pelletized materials help to provide a medium for seed germination and plant growth within the barrier layer 20.

A cover layer 23 may also be provided over the barrier layer 20 to minimize the dissipation of the clay into the water 22, thereby effectively increasing the useful life of the barrier layer 20. Such a cover layer 23 may be formed of a layer of aggregate, such as gravel or sand, which also promotes the growth of vegetation. In a preferred embodiment, the cover layer 23 is formed of an additional layer of the beads 10 which include a setting material such as gypsum or plaster of paris in the sealant layers 12 thereof. The setting material will quickly set when hydrated to form a hard layer over the barrier layer 20, thereby preventing any dissipation thereof into the water 22.

As mentioned above, the beads 10 of the invention may also be used to form barrier layers in the presence of water in a variety of other applications. For instance, a plurality of the beads 10 may be introduced into an annular well space formed between the ground and a well casing, typically formed of steel or plastic. Preferably, the entire annular space is filled with beads. If the annular space is dry, water is added thereto. Once the beads are submerged, the sealant layer about each of the beads 10 begins to absorb water and swell, and a continuous annular layer of the clay and binder is formed.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A material for forming a barrier layer over an underwater surface, comprising:

a plurality of cores; and a sealant layer formed on a surface of each of said cores which includes a binder and a water absorbent clay in an amount sufficient to cause said sealant layer to swell upon contact with water, each of said cores and sealant layer forming a bead having a specific gravity which is greater than one.

2. A material as defined in claim 1, wherein each of said cores is substantially completely encapsulated by said sealant layer.

3. A material as defined in claim 1, wherein said cores are formed of stone.

4. A material as defined in claim 1, wherein said cores are formed of gravel.

5. A material as defined in claim 1, wherein said sealant layer includes a bentonite clay.

6. A material as defined in claim 5, wherein said sealant layer includes calcium bentonite.

7. A material as defined in claim 5, wherein said sealant layer includes sodium bentonite.

8. A material as defined in claim 1, wherein said sealant layer includes attipulgite clay.

9. A material as defined in claim 1, wherein said sealant layer includes an organo clay.

10. A material as defined in claim 1, wherein said binder is a polymeric material.

11. A material as defined in claim 10, wherein said binder includes a cellulosic polymer.

12. A material as defined in claim 1, wherein said binder includes guar gum.

13. A material as defined in claim 1, wherein said sealant layer includes a setting material.

14. A material as defined in claim 13, wherein said setting material is selected from the group consisting of gypsum and plaster of paris.

15. A material as defined in claim 1, wherein said sealant layer includes a bird aversion agent selected from the group consisting of esters of anthranilic acid, esters of phenylacetic acid, and dimethyl benzyl carbinyl acetate.

16. A material as defined in claim 1, further including a protective coating formed on a surface of said sealant layer.

17. A material as defined in claim 16, wherein said protective coating is formed of an acrylic resin.

* * * * *